US006390649B1

(12) United States Patent
Tang

(10) Patent No.: US 6,390,649 B1
(45) Date of Patent: May 21, 2002

(54) PROJECTOR LIGHT HAVING ADJUSTABLE LIGHT BEAM

(76) Inventor: Shih-Chuan Tang, 6F, No. 440-2, Gin Pin Road, Chong Ho City, Taipei Hsien (TW), 235

( * ) Notice: Subject to any disclaimer, the term of this patent is extended or adjusted under 35 U.S.C. 154(b) by 0 days.

(21) Appl. No.: 09/306,214

(22) Filed: May 6, 1999

(51) Int. Cl.[7] ..... F21V 19/00; F21V 21/00

(52) U.S. Cl. ..... 362/285; 362/418; 362/372; 362/404; 362/431

(58) Field of Search ..... 362/285, 418, 362/372, 147, 404, 431

(56) References Cited

U.S. PATENT DOCUMENTS 4,656,398 A * 4/1987 Michael et al. ..... 362/800
4,675,794 A * 6/1987 Fink, Jr. et al. ..... 362/289
5,017,327 A * 5/1991 Bamber ..... 362/399
5,379,204 A * 1/1995 Paterson ..... 362/285

* cited by examiner

*Primary Examiner*—Thomas M. Sember

(57) ABSTRACT

A projector light includes a reflector secured in a frame. A bracket is secured to the frame for engaging with and for securing the reflector in place. A barrel is secured to the bracket for slidably receiving a socket and a light bulb. A knob is secured to the socket for moving the light bulb forward and rearward relative to the reflector and for adjusting the light beam of the projector light. The barrel includes a longitudinal channel for slidably receiving an electric wire which couples the socket to a plug for coupling to an electric power source.

9 Claims, 3 Drawing Sheets

PROJECTOR LIGHT HAVING ADJUSTABLE LIGHT BEAM

BACKGROUND OF THE INVENTION

1. Field of the Invention

The present invention relates to a projector light, and more particularly to a projector light having an adjustable light beam.

2. Description of the Prior Art

Typical projector lights are attached to the ceiling portion of a building and adjustable to different angular position for light various kinds of objects. However, the light beam of the projector light may not be adjusted.

The present invention has arisen to mitigate and/or obviate the afore-described disadvantages of the conventional projector lights.

SUMMARY OF THE INVENTION

The primary objective of the present invention is to provide a projector light having an adjustable light beam for allowing the projector light to be easily adjusted to different light beams.

In accordance with one aspect of the invention, there is provided a projector light comprising a frame including a front portion and including an inner peripheral portion, a reflector secured in the frame, a bracket secured to the frame, a barrel secured to the bracket, a socket slidably received in the barrel, at least one light bulb attached to the socket and slidably received in the reflector, and means for moving the light bulb forward and rearward relative to the reflector to adjust a light beam of the projector light.

A cylindrical cap is further secured to the front portion of the frame and is preferably made of glass materials for generating different light emitting patterns. The front portion of the frame includes a peripheral flange provided therein, the cylindrical cap includes an annular flange extended therefrom and engaged with the peripheral flange of the frame.

A slide is further slidably received in the barrel, means for securing the socket to the slide. A knob is secured to the slide for moving the slide and the socket and the light bulb forward and rearward relative to the reflector.

A plug is further provided and coupled to the socket with an electric wire. The barrel includes a longitudinal channel for slidably receiving the electric wire and for allowing the socket to be moved along the barrel. A tube is further provided for receiving the electric wire, the tube includes a first end having the plug secured thereto. The tube includes a second end, the projector light further includes a coupler secured to the second end of the tube and secured to the frame.

The bracket includes two ends each having a spring blade engaged with the reflector for resiliently clamping the reflector in place. The inner peripheral portion of the frame includes an annular slot formed therein, the ends of the bracket each includes at least one fin engaged into the annular slot of the frame.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
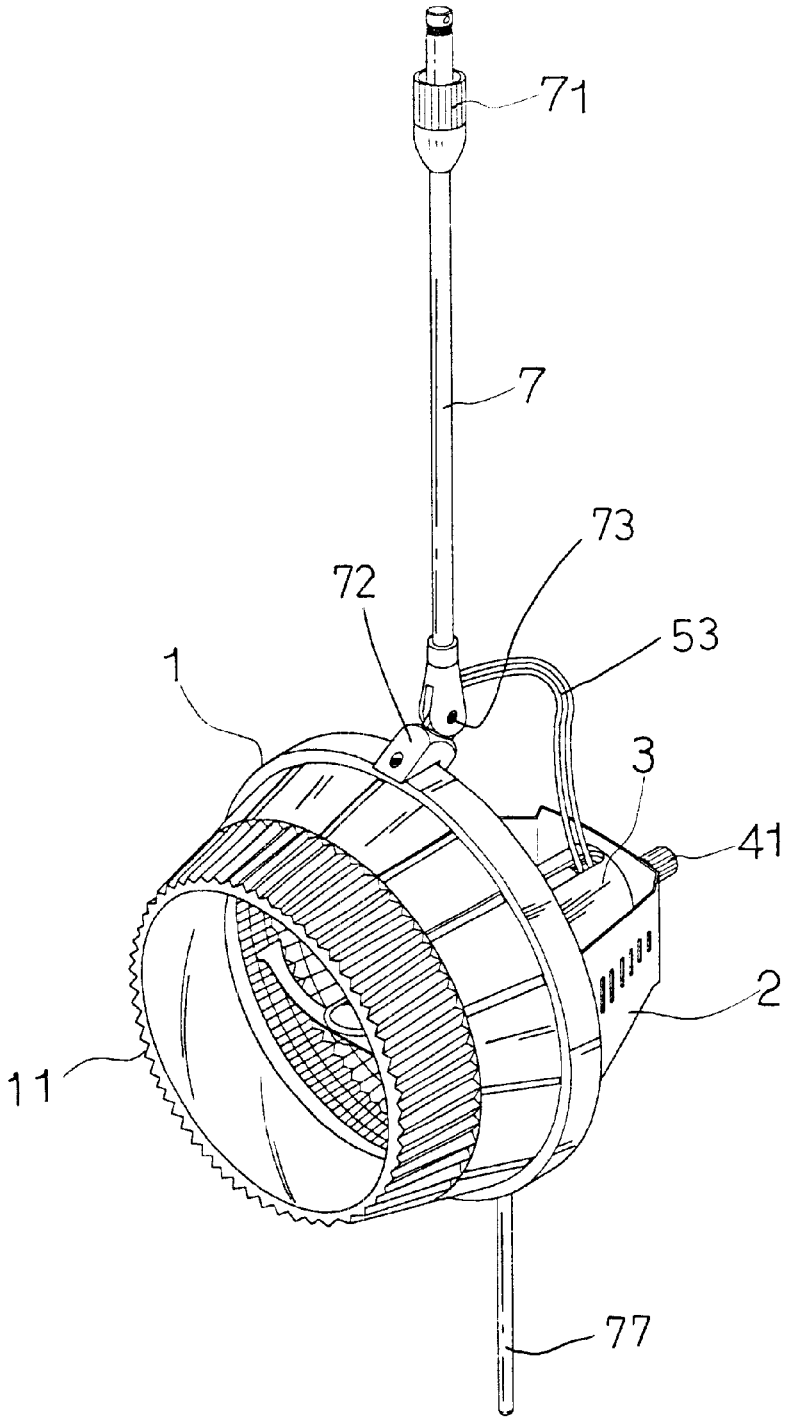
FIG. 1 is a perspective view of a projector light in accordance with the present invention.
Figure 2:
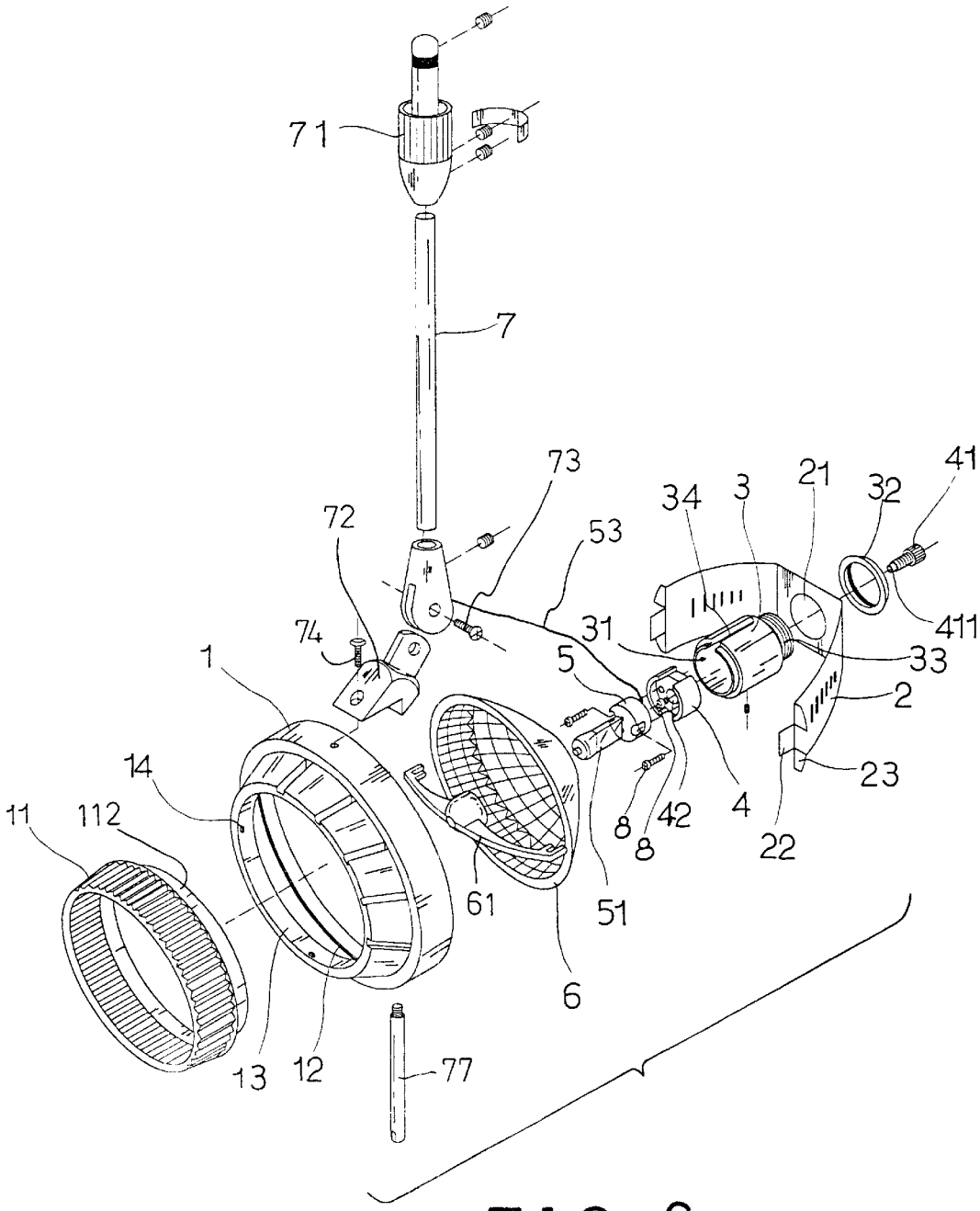
FIG. 2 is an exploded view of the projector light.

Referring to the drawings, and initially to FIGS. 1 and 2, a projector light in accordance with the present invention comprises a frame 1 including an annular slot 12 formed therein and including a peripheral flange 13 of a reduced size extended forward therefrom and including one or more holes or projections 14 extended radially inward from the inner peripheral portion of the peripheral flange 13. A cylindrical cap 11 is made of glass materials and includes an annular flange 112 extended rearward therefrom and engaged into the frame 1 and engaged with the peripheral flange 13 of the frame 1. The cylindrical cap 11 includes one or more latch grooves formed therein for receiving the projections 14 of the frame 1 and for securing to the frame 1. Or, alternatively, one or more fasteners may engaged through the peripheral flange 13 of the frame 1 and engaged with the annular flange 112 of the cylindrical cap 11 for securing the cylindrical cap 11 to the frame 1. A reflector 6 has a front portion engaged with the peripheral flange 13 of the frame 1. A protector beam 61 is secured to the front portion of the reflector 6.

A bracket 2 includes a substantially C-shape having two ends each including one or more fins 23 extended therefrom for engaging into the annular slot 12 of the frame 1 and including one or more spring blade 22 extended therefrom for engaging with the reflector 6 and for resiliently clamping the reflector 6 in place. The bracket 2 includes a middle portion having an orifice 21 formed therein. A barrel 3 has one end 33 extended rearward through the orifice 21 of the bracket 2 and a nut 32 is threaded to the rear end 33 of the barrel 3 and engaged with the bracket 2 for securing the barrel 3 to the bracket 2. The barrel 3 includes a longitudinal channel 34 formed therein and includes a bore 31 formed therein for slidably receiving a slide 4. The slide 4 includes an aperture 42 formed therein for receiving a fastener 8 which is threaded to a screw hole 411 of a knob 41, such that the slide 4 may be moved along the barrel 3 by the knob 41. The knob 41 is extended rearward and outward of the bracket 2 for moving the slide 4 along the barrel 3. A socket 5 is secured to the slide 4 by one or more fasteners 8 for engaging with one or more light bulbs 51 which are slidably received in the reflector 6.

A tube 7 includes a plug 71 secured to one end thereof and includes the other end pivotally coupled to a coupler 72 by at a pivot shaft which may be fastener 73 for securing the tube 7 and the coupler 72 together. The coupler 72 may then be secured to the frame 1 by one or more fasteners 74. An electric wire 53 is threaded through the tube 7 and has one end electrically coupled to the plug 71 and has the other end engaged through the channel 34 of the barrel 3 and electrically coupled to the socket 5. The electric wire 53 may be moved along the channel 34 of the barrel 3 (FIGS. 3, 4) when the slide 4 is moved along the barrel 3, such that the electric coupling between the plug 71 and the socket 5 will not be interfered. An extension 77 may be secured to the bottom of the frame 1 for attaching onto an object or for engaging into the ground, for example.

Figure 4:
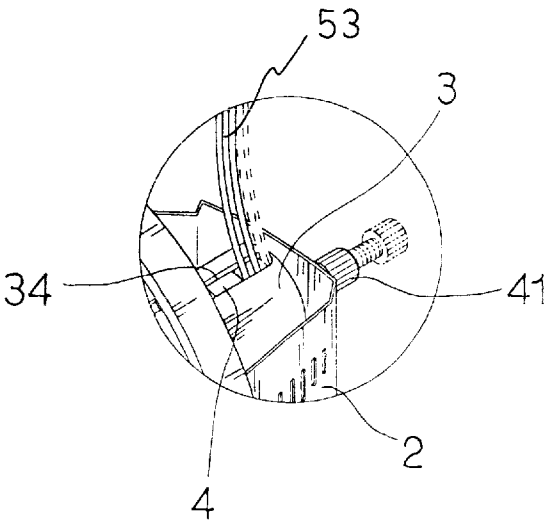
FIG. 4 is a partial perspective view of the projector light.
Figure 3:
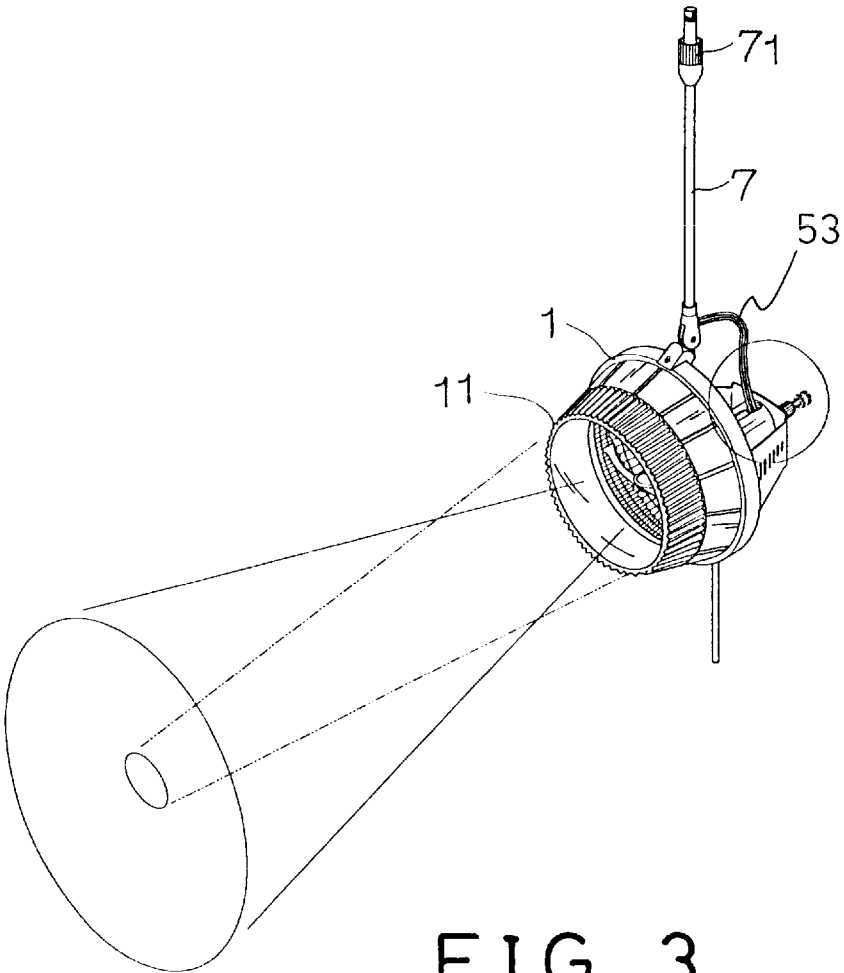
FIG. 3 is a perspective view illustrating the operation of the projector light.

In operation, as shown in FIGS. 3 and 4, when the slide 4 and thus the socket 5 and the light bulb 51 are moved forward and rearward relative to the reflector 6, the light beams of the projector light may thus be adjusted. The light generated by the light bulb 51 and emitted through the cylindrical cap 11 of glass materials may generate various kinds of light patterns.

Accordingly, the projector light in accordance with the present invention may be easily adjusted to different light beams.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A projector light comprising:

a frame including a front portion and including an inner peripheral portion, a reflector secured in said frame, a bracket secured to said frame, a barrel secured to said bracket, a socket slidably received in said barrel, at least one light bulb attached to said socket and slidably received in said reflector, means for moving said at least one light bulb forward and rearward relative to said reflector to adjust a light beam of said projector light, plug, an electric wire coupling said plug to said socket, and a tube for receiving said electric wire, said tube including a first end having said plug secured thereto.

2. The projector light according to claim 1 further comprising a cylindrical cap secured to said front portion of said frame.

3. The projector light according to claim 2, wherein said front portion of said frame includes a peripheral flange provided therein, said cylindrical cap includes an annular flange extended therefrom and engaged with said peripheral flange of said frame.

4. The projector light according to claim 1 further comprising a slide slidably received in said barrel, means for securing said socket to said slide.

5. The projector light according to claim 4 further comprising a knob secured to said slide for moving said slide and said socket and said at least one light bulb forward and rearward relative to said reflector.

6. The projector light according to claim 1, wherein said barrel includes a longitudinal channel formed therein for slidably receiving said electric wire and for allowing said socket to be moved along said barrel.

7. The projector light according to claim 1, wherein said tube includes a second end, said projector light further includes a coupler secured to said second end of said tube and secured to said frame.

8. A projector light comprising:

a frame including a front portion and including an inner peripheral portion, a reflector secured in said frame, a bracket secured to said frame, said bracket including two ends each having a spring blade engaged with said reflector for resiliently clamping said reflector to said frame, a barrel secured to said bracket, a socket slidably received in said barrel, at least one light bulb attached to said socket and slidably received in said reflector, and means for moving said at least one light bulb forward and rearward relative to said reflector to adjust a light beam of said projector light.

9. The projector light according to claim 8, wherein said inner peripheral portion of said frame includes an annular slot formed therein, said ends of said bracket each includes at least one fin engaged into said annular slot of said frame.

* * * * *